United States Patent [19]

Teach

[11] 4,129,224

[45] Dec. 12, 1978

[54] AUTOMATIC CONTROL OF BACKHOE DIGGING DEPTH

[75] Inventor: Ted L. Teach, Dayton, Ohio

[73] Assignee: Laserplane Corporation, Dayton, Ohio

[21] Appl. No.: 833,432

[22] Filed: Sep. 15, 1977

[51] Int. Cl.[2] ..... E02F 9/20

[52] U.S. Cl. ..... 214/763; 37/DIG. 1; 214/152; 214/761

[58] Field of Search ..... 214/1 CM, 138 R, 152, 214/761, 762, 763, DIG. 2; 37/DIG. 1; 172/2, 4, 4.5

[56] References Cited

U.S. PATENT DOCUMENTS

| | | | |
|---|---|---|---|
| 3,586,184 | 6/1971 | Pesquento et al. | 214/1 CM X |
| 3,997,071 | 12/1976 | Leach | 214/761 |
| 4,044,610 | 8/1977 | Oldaeus et al. | 214/138 R X |

FOREIGN PATENT DOCUMENTS

| | | | |
|---|---|---|---|
| 397603 | 1/1974 | U.S.S.R. | 214/763 |

*Primary Examiner*—L. J. Paperner
*Attorney, Agent, or Firm*—W. A. Schaich

[57] ABSTRACT

In a backhoe of the type having an outreach boom horizontally pivotally mounted relative to a vehicle and an hydraulic cylinder therebetween, a downreach boom horizontally pivotally mounted on the free end of the outreach boom and an hydraulic cylinder therebetween, and a digging bucket horizontally pivotally mounted on the free end of the downreach boom and an hydraulic cylinder therebetween, apparatus is provided for respectively generating signals proportional to the angle between the outreach boom and the horizontal, the angle between the outreach boom and the downreach boom, the angle between the downreach boom and a line drawn to the digging teeth of the bucket, and an angle equal to the desired slope of the bottom of the excavation relative to the true horizontal. Such signals are combined according to a trigonometric equation to provide a continuous signal and/or visual indication to indicate the absolute elevation of the digging teeth of the backhoe bucket and the same signals are also utilized to control the hydraulic cylinders and the relationships between the aforementioned angles so that the digging teeth of the bucket move parallel to the desired slope of the bottom of the excavation throughout the digging stroke.

6 Claims, 3 Drawing Figures

AUTOMATIC CONTROL OF BACKHOE DIGGING DEPTH

BACKGROUND OF THE INVENTION

In my prior U.S. Pat. No. 3,997,071, I have provided electrical transducers proportional to each of the primary angles involved in the operation of a backhoe and combined the signals generated by such transducers according to a trigonometric equation to provide a signal which indicates the effective depth of the teeth of the bucket of the backhoe relative to the pivotal mounting of the backhoe on a vehicle. In a modification described in the aforementioned patent, I have combined the depth indicating signal with a signal generated in accordance with the vertical displacement of the pivotal mounting of the backhoe relative to a reference plane defined by rotating a laser beam over the working area of the machine to provide a continuous indication of the vertical displacement of the digging teeth relative to the reference plane.

The aforedescribed apparatus continuously indicates to the operator the depth position of the digging teeth of the backhoe, but it is still left to the operator's skill to manipulate the various control levers which respectively control the three primary hydraulic cylinders involved in the operation of the backhoe, to cause the digging teeth to move in a path parallel to a desired reference plane and thus produce a trench bottom of not only the desired depth but also the proper slope.

As is well-known, the speed of the digging operation employing a backhoe is primarily determined by the rate of change of the angle between the outreach boom and the downreach boom of the backhoe. If the operator could concentrate on changing this angle during the digging stoke as rapidly as permitted by the soil conditions, without having to concurrently adjust the cylinders controlling the two other basic angles of the backhoe, the speed of the digging operation could be measurably increased, but no apparatus has heretofore been provided that would permit the operator to manually control only the hydraulic cylinder which determines the aforementioned angle and still maintain the digging teeth of the backhoe moving along a plane parallel to the desired slope of the bottom of the excavation.

OBJECTS OF THE INVENTION

Accordingly, it is an object of this invention to provide a method and apparatus for assisting a backhoe operator to consistently move the digging teeth of the backhoe bucket along a plane parallel to the desired slope of the bottom of the excavation.

Another object of the invention is to provide apparatus for automatically controlling two of the three primary angles involved in the operation of a backhoe so that irrespective of the rate of change of the angle between the outreach boom and the downreach boom, the teeth of the digging bucket will follow a path parallel to the desired slope of the bottom of the excavation.

A further object of the invention is to provide apparatus for automatically controlling two of the three primary angles involved in the operation of a backhoe as a function of the third primary angle and the angle of the desired slope of excavation with respect to the horizontal so that the teeth or edge of the digging bucket will not only follow a path parallel to the desired slope of the bottom of the excavation but will also maintain a constant angle of attack with respect to the bottom of the excavation.

A particular object of this invention is to provide a control apparatus for a backhoe wherein the absolute digging depth of the teeth of the backhoe is continuously indicated relative to a reference plane defined by a rotating laser beam and the cylinders controlling the primary angles of the backhoe are controlled either manually or automatically to consistently move the digging teeth of the backhoe along a plane parallel to the reference plane defined by the rotating laser beam.

Further objects and advantages of the invention will become apparent to those skilled in the art from the following detailed description, taken in conjunction with the annexed sheets of drawings.

DESCRIPTION OF THE INVENTION

Figure 1:
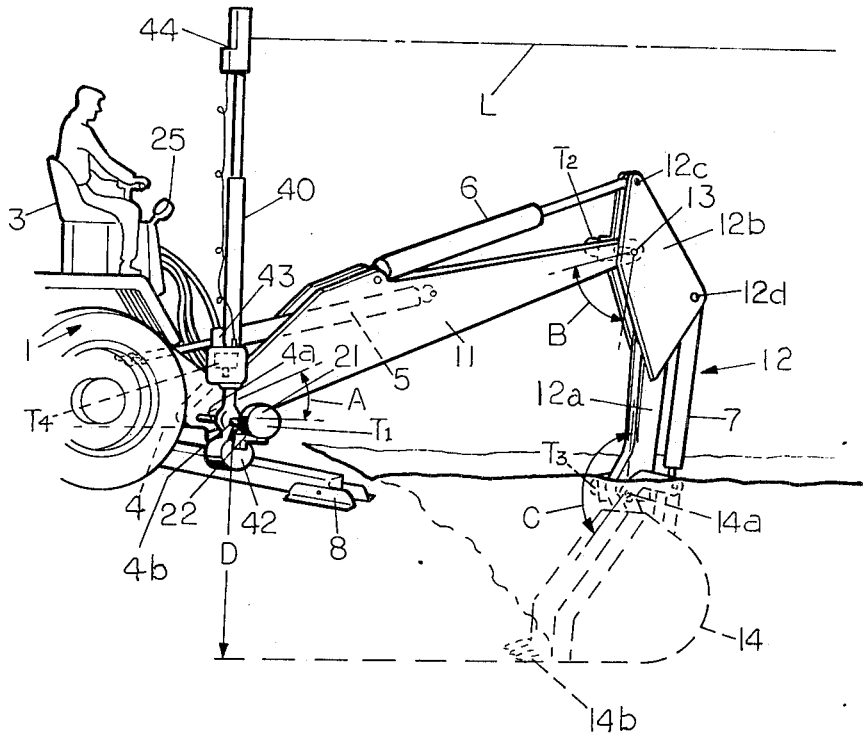
FIG. 1 is a side elevational, schematic view of a prior art form of backhoe mounted on an industrial tractor and embodying digging depth indicating and controlling apparatus.

As is well-known in the backhoe art, such backhoes comprise an outreach boom 11 formed by two spaced triangular plate members suitably secured together by weldments to form a rigid truss element. The forward end of outreach boom 11 is appropriately secured to a transverse shaft **4*a* journalled by a mounting bracket 4. Bracket 4 is pivotally mounted to vehicle 1 for horizontal swinging movements by conventional means (not shown). Hydraulic cylinder 5 operates between the bracket 4 and the outreach boom 11 to control the vertical pivotal position of said outreach boom 11 relative to the vehicle. A pair of laterally projecting stabilizing pads 8 are also attached to vehicle 1** in conventional fashion.

At the free end of the outreach boom 11, a downreach boom 12 comprises a main structural frame element **12*a* to which a pair of generally triangular plates 12*b* are respectively secured by welding in opposed relationship. The plates 12*b* are traversed by the mounting pin 13 and also support a pivotal mounting pin 12*c* which receives the end of a cylinder unit 6 which operates between the outreach boom 11 and the downreach boom 12 to control the relative angular positions of said booms. A third pivot mounting pin 12*d* provides a pivot mounting for a cylinder unit 7 which controls the pivotal position of a digging bucket 14 which is pivotally mounted to the free end of the downreach boom 12 as by pivot pin 14*a*. Bucket 14 is of conventional configuration and has digging teeth 14*b* at its extreme lower edge. Obviously, it is the vertical position or depth of the digging teeth 14*b* that determines the effective digging depth of the bucket 14**.

Each of the cylinders 5, 6 and 7 respectively controlling the position of the outreach boom 11 relative to the vehicle, the pivotal position of the downreach boom 12 relative to the outreach boom 11, and the position of the bucket 14 with respect to the end of the downreach boom 12, is normally manually controlled by conventional individual hydraulic controls positioned immediately adjacent the operator's seat on the vehicel 1. By varying the relative angle of the outreach boom 11 with respect to the vehicle, the digging bucket may be moved to a digging position beneath the ground. The path of the digging bucket through the ground is obviously controlled by the operator by making the appropriate variations of the relative angles between the outreach boom 11, the downreach boom 12 and the digging bucket 14.

At each of the major pivotal axes involved in the operation of the backhoe, transducers T1, T2 and T3 are respectively mounted. Transducers T1, T2 and T3 are of a conventional type which produce an electrical signal proportional to the angular displacement of the shaft (not shown) relative to the circular body 21 of the transducer. For example, the transducer may be the type manufactured and sold by Trans-Tek, Inc. of Ellington, Connecticut. The shaft of transducer T1 is suitably co-axially secured to an extension 4*b* of the pivot mounting shaft 4*a*. The shaft of transducer T2 is suitably secured to the pin 13 by which the downreach boom 12 is pivotally secured to the outreach boom 11. Lastly, the shaft (not shown) of transducer T3 is secured to the pivot shaft 14*a* by which the digging bucket 14 is pivotally secured to the end of the downreach boom 12. Suitable brackets 22 are provided for mounting the cylindrical body portions 21 of each of the transducers T1, T2 and T3 so that any movement of the respective booms produces a movement of the shafts relative to the body portion 21 of the particular transducer mounted at such pivotal axis. Bracket 22 of transducer T1 is secured to pendulum 42 to produce a signal proportional to the angle A between the boom 11 and the horizontal.

Figure 2:
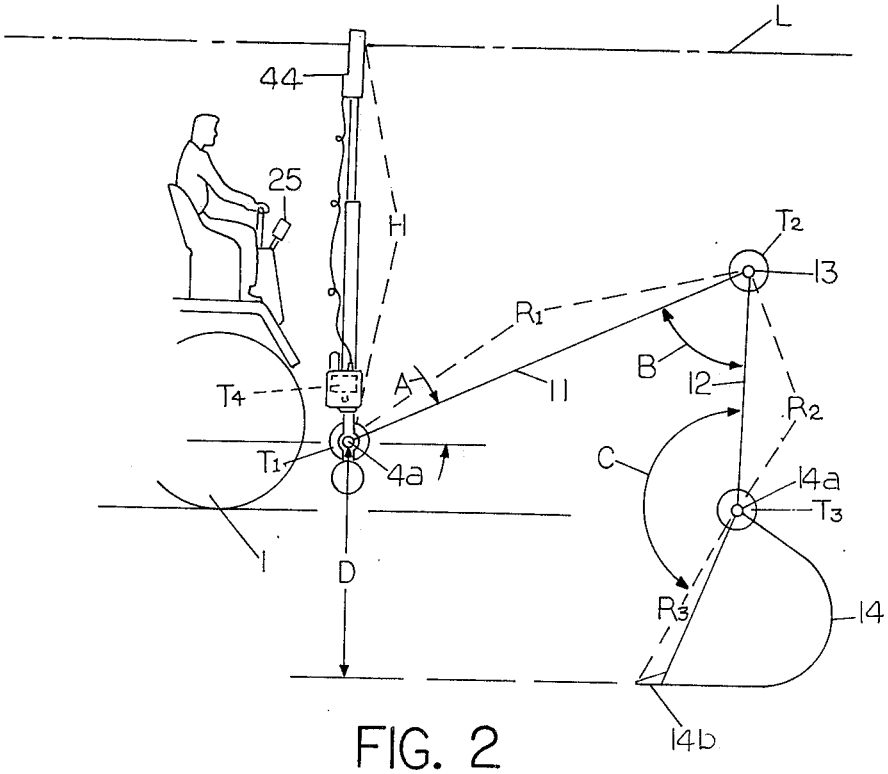
FIG. 2 is a schematic representation of the movable elements of the backhoe of FIG. 1 for the purpose of trigonometric analysis of the position of the cutting teeth of the backhoe.

Referring now to the simplified diagram of the backhoe shown in FIG. 2, the distance R1 represents the effective length of the outreach boom 11 between the pivot mounting pins 4*a* and 13. The distance R2 is the effective length of the downreach boom 12 between the pivot pins 13 and 14*a*. Lastly, the distance R3 is the effective distance from the pivot mounting pin 14*a*, by which the digging bucket is secured to the downreach boom, to the end of the digging teeth 14*b*. The angle A is the angle between the outreach boom 11 and the horizontal, the angle B is the angle between the outreach boom 11 and the downreach boom 12, and the angle C is the effective angle between the downreach boom 12 and the line R3 drawn between the digging teeth and the pivot mounting axis 14*a* of the bucket 14.

By applying conventional trigonometric analysis, the distance D between the pivot axis 4*a* provided on the vehicle for mounting the outreach boom 11 and the digging depth of the teeth 14*b* of the bucket 14 may be found to be determined by the following equation:

$$D = R1 \sin A - R2 \sin (A + B) = R3 \sin (A + B + C).$$

It necessarily follows that if electrical signals can be generated which are respectively proportional to R1, R2, and R3, angle A, angle B, angle C, and sin A, sin (A + B), and sin (A + B + C) then an electrical signal proportional to the depth D may be developed. Since R1, R2, and R3 are known constants, there is no problem in producing an electrical signal proportional to such constants. The transducers T1, T2, and T3 will respectively provide electrical signals proportioned to the angle A, the angle B, and the angle C. Lastly, devices are known in the art for producing signals proportional to a trigonometric function of an input signal. Such device, for example, may comprise the model 435 Analog Operator manufactured and sold by Bell & Howell, Inc., of Bridgeport, Connecticut. Therefore, by the use of such devices, it is possible to obtain electrical signals respectively proportional to sin A, sin (A + B), and sin (A + B + C).

Accordingly, appropriate electrical circuitry is set up to effect the combination of signals respectively proportional to R1, R2, R3, sin A, sin (A + B) and sin (A + B + C), resulting in an electrical signal proportional to D, which is the distance from the pivot axis 4*a* on the vehicle bracket 4 to the digging teeth 14*b* of the backhoe bucket 14. This signal may be read on an appropriate ammeter or voltmeter 25 which is calibrated in appropriate depth units.

As is well-known to operators of backhoes, the vertical height of the pivot axis of the backhoe may very well shift during the digging operation, due to the weight of the vehicle effecting a settling of the vehicle support pads 8. Accordingly, if it is desired to know in absolute terms the working depth of the teeth 14*b* of the backhoe bucket, then it is necessary to know the absolute height of the pivot axis 4*a* with respect to a reference plane. Referring to FIGS. 1 and 2, such reference plane may be defined by a laser beam L which is periodically swept over the area. The apparatus for generating such rotating laser beam may be that disclosed in Studebaker Patent, U.S. Pat. No. 3,588,249.

To detect the reference plane defined by the laser beam L, an upstanding mast 40 is provided constituting an extension of pendulum 42 having the bottom end thereof pivotally mounted on extension 4*b* of the pivot pin 4*a* which mounts the outreach boom 11 to the bracket 4. Mast 40 is supported in a true vertical position by the pendulum weight 42 positioned below the pivot mounting pin 4*b*. Mast 40 may be identical to that disclosed in my earlier U.S. Pat. No. 3,825,808 and incorporates a motor 43 for extending or contracting the vertical height of mast 40. At the top of mast 40, a laser beam sensor unit 44 is mounted comprising a plurality of vertically stacked cells (not shown) which generate electrical signals when impinged by the laser beam L. The same circuitry as described in my prior U.S. Pat. No. 3,825,808 may be employed to automatically effect the raising or lowering of mast 40 through the operation of the motor 43 to keep the center of the vertically stacked array of laser beam receiving cells in exact alignment with the reference plane defined by the laser beam L. The resulting vertical movements of the mast 40 may be translated into a rotational movement as described in said patent and such rotational movement detected by a transducer T4 (FIG. 2), thus producing an electrical signal proportional to the height of the mast 40, hence proportional to the absolute vertical spacing H (FIG. 2) between the pivot axis 4*a* and the reference plane defined by the laser beam L. The signal from transducer T4 may be added to the signal D and thus the indicating instrument 25 will now indicate the absolute elevation, or displacement of the cutting teeth 14*b* of the backhoe bucket relative to the reference plane defined by the laser beam L.

Everything thus far described is disclosed in my aforementioned U.S. Pat. No. 3,997,071. Further studies of the angular relationship between the primary structural elements of a backhoe have convinced me that it is possible to visually indicate, or automatically control, the effective path of the teeth 14b of the backhoe so as to move such teeth not only at a desired depth but along a plane parallel to the reference plane defined by the rotating laser beam L.

Figure 3:
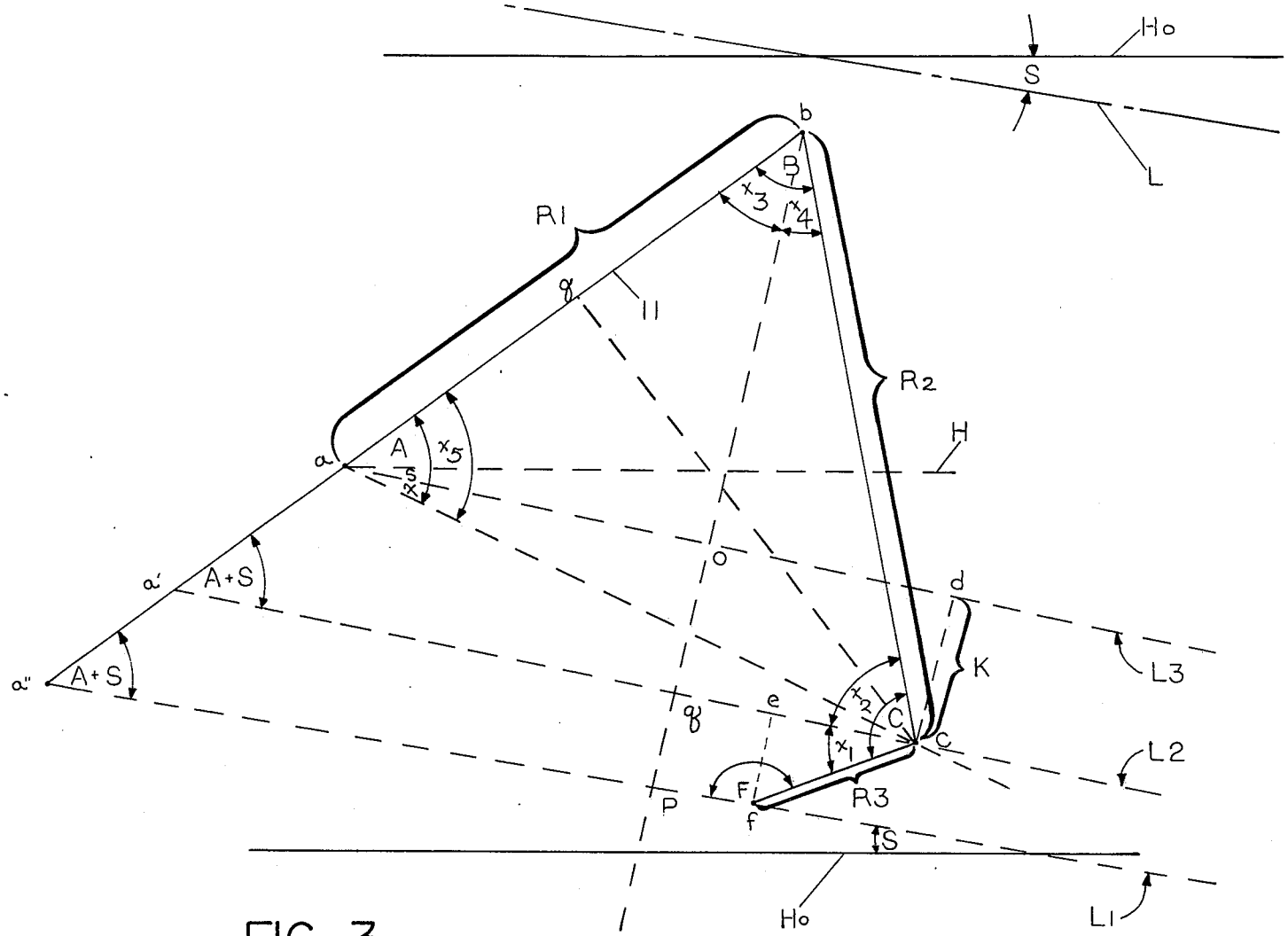
FIG. 3 is a view similar to FIG. 2, but using only lines to represent the components of the backhoe as the digging edge or teeth of the digging bucket are moved in a digging stroke along a plane parallel to that defined by a reference plane created by rotating a laser beam above the working area and the digging angle of the bucket relative to the said plane is maintained at a constant angle.

Referring now particularly to FIG. 3, the plane defined by the rotating laser beam L is shown as being at a slight inclination angle S relative to the true horizontal indicated by the line Ho. This is a common situation encountered when a backhoe is utilized for a trenching operation. There is schematically shown in solid lines the primary elements of the backhoe at any position in a digging stroke and, by dotted line L1, the path of the digging edge or teeth f as the digging teeth of the backhoe move in a plane parallel to a reference plane defined by the rotating laser beam L, which is at an angle S to the horizontal Ho. It is readily apparent that some relationship between the angles A, B, C and S must be maintained in order to have the digging edge or teeth f of the bucket move as indicated in FIG. 3.

This invention permits the teeth or digging edge of the backhoe bucket to not only be readily controlled to move along a path parallel to the desired slope of the bottom of the excavation, but concurrently the digging angle or attack angle of the bucket may be maintained at a constant value relative to the bottom of the excavation to provide a consistent bite of the bucket throughout the digging stroke. The attack angle referred to is the angle F, and it should be noted that this angle is maintained at the constant value throughout the digging stroke. Under such circumstances, the angle C must necessarily vary, and, in accordance with this invention, means are provided for automatically controlling the angle C so that the attack angle F remains at a constant value throughout the digging stroke.

FIG. 3 clarifies the trigonometric relationship between the various angles involved in this mode of operation of the backhoe. FIG. 3 is similar to FIG. 2, except that line L1 representing the desired trench bottom, has been extended out to meet an extension of the line 11 representing the outreach boom. The angle between the extension of line 11 and the line L1 is referred to as angle A + S because this is its value.

In essence, we want point f to move along L1 with angle F held constant. The angle relations are:

$$A + S + B + C + F = 360^\circ \text{ (sum of interior angles of four-sided polygon} = 360^\circ$$

Since our stated premise is that the angle F should remain constant, this equation reduces in all positions of the backhoe elements operating in this mode to:

$$A + S + B + C = 360^\circ - F = K1 \text{ (a constant)}$$

It will be noted however that over the length of a normal digging stroke, the angle S is substantially constant. Inserting this value for angle S into the preceding equation results in the following equation:

$$A + B + C = K2 \text{ (another constant)}$$

or angle C is equal to K2 minus (A + B) and angle A is equal to K2 minus (B + C).

Now, in every position of the backhoe elements, the angles A, B, and C are known and their values are indicated by electrical signals respectively generated by the transducers T1, T2, and T3. Therefore, through the application of conventional circuitry, the angle C may be automatically controlled as a function of angles A and B through application of a signal to the hydraulic valve controlling the cylinder 7, which signal is determined by the above equation for the angle C. The angle A may be automatically determined by applying a signal to the control valve for the hydraulic cylinder 5 which is determined as a function of angle B from the following analysis based on FIG. 3 on which:

Lines L2 and L3 are drawn through points 'c' and 'a' respectively and are parallel to L1.

Line b o q p is drawn through point 'b' perpendicular to lines L3, L2 and L1.

Line c g is drawn through point 'c' perpendicular to line 11.

Line c d is drawn through point 'c' perpendicular to line L3.

Line e f is drawn through point 'f' perpendicular to line L2.

We may then proceed with the following trigonometric analysis.

$$x2 + A + S + B = 180^\circ$$

or $$x2 = 180^\circ - A - S - B$$

now $$x1 = C - x2 = A + S + B + C - 180^\circ$$

also $$x3 + A + S + 90^\circ = 180^\circ$$

or $$x3 = 90^\circ - A - S$$

next $$x4 = B - x3 = A + S + B - 90^\circ$$

and $$x5 = A + S + x$$

or $$A = S + x - x5$$

So we need only to define x and x5 as a function of angle B.

We first define the lengths $$ef = pq = R3 \sin x1 = R3 \sin (A + S + B + C - 180^\circ = \text{constant}$$

but $$R3 \sin (A + S + B + C - 180^\circ) = - R3 (\sin A + S + B) = \text{constant}$$

$$qb = R2 \cos x4 = R2 \cos (A + S + B - 90°) = R2 \sin (A + S + B)$$

$$ob = R1 \sin (A + S)$$

then $$K = cd = oq = gb = qb - ob = R2 \sin (A + S + B) - R1 \sin (A+S)$$

Further $$ag = R1 - bg = R1 - R2 \cos B$$

$$cg = R2 \sin B$$

$$ac = [(R2 \sin B)^2 + (R1 - R2 \cos B)^2]^{\frac{1}{2}}$$

and $$x5 = \sin^{-1} (cg/ac)$$

also $$ad = (ac)^2 - K^{2\,\frac{1}{2}}$$

and $$x = \sin^{-1} (K/ac)$$

therefore $$A = x5 - S - x = \sin^{-1} (cg/ac) - S - \sin^{-1} (K/ac)$$

$$A = sin^{-1} \frac{R2 \sin B}{[(R2 \sin B)^2 + (R1 - R2 \cos B)^2]^{\frac{1}{2}}} - S - \sin^{-1} \frac{K}{[(R2 \sin B)^2 + (R1 - R2 \cos B)^2]^{\frac{1}{2}}}$$

From the above it is apparent that angle A may be determined at any point in the digging stroke as a function of angle B known constants R1, R2 and K. As pointed out above, the constant K may be computed from the known values of angles A, B and S at the beginning of the digging stroke from the equation $$K = R2 \sin (A_o + S + B_o) - R1 \sin (A_o + S)$$

where $A_o$ and $B_o$ are the measured values of angles A and B at the beginning of the digging stroke.

The operation of a backhoe in accordance with this invention will now be readily apparent to those skilled in the art. A number of micro-processors or mini-computers are available in the trade which may be programmed to calculate the value of K from the values of Angles $A_o$, $B_o$, Angle S and the lengths R1 and R2. The same or a similar mini-computer can be programmed to calculate the value of the Angle A according to the arc sine equation set forth above by feeding to the computer signals proportional to Angle B, Angle S and the lengths R1 and R2. The signal representing the output of this calculation is applied to control the hydraulic cylinder 6 which determines Angle A. Lastly, the hydraulic cylinder 7, which controls Angle C is controlled as a linear function of the Angles A and B according to the relationship set forth above, namely Angle C = K2 − (A + B).

The electronic computing of the required values of Angle A and C and the generation of signals proportional to such required values to respectively control the hydraulic cylinders 5 and 7 as hydraulic cylinder 6 is manually controlled to vary Angle B, constitute techniques that are well know in the art.

Those skilled in the art will also recognize that it is immaterial as to whether the required Angle A is computed as a trigonometric function of Angle B and then Angle C determined as a linear function of Angles A and B, or conversely the Angle C is computed as a trigonometric function of the Angle B and the Angle A is computed as a linear function of the Angles B and C. In either event the operator of the backhoe needs only to manually control the hydraulic cylinder 6 to move the bucket through a digging stroke and the Angles A and C will then be automatically maintained at the required values throughout such stroke so as to move the digging teeth of the bucket along a line parallel to the desired slope of the excavation, such as the line L1 in FIG. 3. Concurrently the depth of the digging teeth of the bucket relative to the overhead reference plane L produced by the rotating laser beam is continuously calculated and indicated on meter 25.

Further modifications of this invention will be readily apparent to those skilled in the art and it is intended that the scope of the invention be limited only as defined in the appended claims.

I claim:

1. The method of operating a backhoe to move the digging edge of the bucket thereof along a path parallel to the desired slope of the bottom of the excavation and with the digging angle of the bucket being substantially constant with respect to said desired slope, said backhoe having an outreach boom vertically pivotal about a horizontal axis defining an Angle A with respect to the horizontal, a downreach boom pivotally secured to the free end of the outreach boom to define an Angle B therebetween, and a digging bucket pivotally secured to the other end of the downreach boom to define Angle C between the digging edge of the bucket and its pivotal axis on the downreach boom, there being three power-actuating means respectively operating on said outreach boom, said downreach boom, and said digging bucket to vary said Angles A, B and C, comprising the steps of:

(1) manually controlling the power-actuating means determining Angle B to move said bucket through a digging stroke;

(2) generating a first electrical signal continuously proportional to Angle B;

(3) controlling one of the two remaining power-actuating means as a trigonometric function of Angle B, the length of the outreach boom, and the length of the downreach boom, thereby determining either Angle A or Angle C;

(4) generating a second electrical signal continuously proportional to the Angle determined by step (3); and (5) controlling the remaining power-actuating means as a linear function of the sum of the electrical signals generated in steps (2) and (4).

2. The method defined in claim 1 wherein the trigonometric relationship between Angle A and Angle B is defined by the equation $$A = sin^{-1} \frac{R2 \sin B}{[(R2 \sin B)^2 + (R1 - R2 \cos B)^2]^{\frac{1}{2}}} - S - \sin^{-1} \frac{K}{[(R2 \sin B)^2 + (R1 - R2 \cos B)^2]^{\frac{1}{2}}}$$

where

R1 equals the length of the digging boom,

R2 equals the length of the downreach boom,

S is the angle between the desired slope of the excavation and the horizontal, and $$K = R2 \sin (A_o + S + B_o) - R1 \sin (A_o + S)$$

where $A_o$ and $B_o$ are measured values of Angles A and B at the beginning of the digging stroke, and the linear relationship between the Angle C and Angles A plus B is defined by the equation A = K2 − (B + C).

3. The method of claim 1 plus the step of concurrently indicating the depth of the digging edge of the bucket throughout said digging stroke.

4. The method of operating a backhoe to move the digging edge of the bucket thereof along a path parallel to the desired slope of the bottom of the excavation and with the digging angle of the bucket being substantially constant with respect to said desired slope, said backhoe having a power-actuated outreach boom vertically pivotal about a horizontal axis and defining an Angle A with respect to the horizontal, a downreach boom pivotally secured to the free end of the outreach boom and power-actuated relative thereto to define an Angle B therebetween, and a digging bucket pivotally secured to the other end of the downreach boom and power-actuated relative to define an Angle C between the digging edge of the bucket and the axis of the downreach boom, comprising the steps of:

(1) generating a first electrical signal continuously proportional to Angle B;

(2) controlling the power actuation of the outreach boom, hence Angle A, as a trigonometric function of Angle B, the length of the outreach boom, and the length of the downreach boom;

(3) generating a second electrical signal continuously proportional to the Angle A;

(4) controlling the power-actuation of the digging bucket relative to the downreach boom, hence Angle C, as a linear function of the sum of Angles A and B; and (5) manually controlling the power-actuation of the downreach boom through a digging stroke, thereby varying Angle B.

5. Apparatus for controlling a backhoe to move the digging edge of the bucket thereof along a path parallel to the desired slope of the bottom of the excavation and with the digging angle of the bucket being substantially constant with respect to said desired slope, said backhoe having an outreach boom vertically pivotal about a horizontal axis defining an Angle A with respect to the horizontal, a downreach boom pivotally secured to the free end of the outreach boom to define an Angle B therebetween, and a digging bucket pivotally secured to the other end of the downreach boom to define an Angle C between the digging edge of the bucket and its pivotal axis on the downreach boom, comprising, in combination:

(1) three power-actuating means respectively operating on said outreach boom, said downreach boom, and said digging bucket to vary said Angles A, B and C;

(2) means for continuously generating electrical signals respectively proportional to said Angles A, B and C;

(3) computer means for generating a signal according to the following equation:

$$A = \sin^{-1} \frac{R2 \sin B}{[(R2 \sin B)^2 + (R1 - R2 \cos B)^2]^{\frac{1}{2}}} - S - \sin^{-1} \frac{K}{[(R2 \sin B)^2 + (R1 - R2 \cos B)^2]^{\frac{1}{2}}}$$

where

R1 equals the length of the digging boom,

R2 equals the length of the downreach boom,

S is the angle between the desired slope of the excavation and the horizontal, and $$K = R2 \sin (A_o + S + B_o) - R1 \sin (A_o + S)$$

where $A_o$ and $B_o$ are the measured values of Angle A and B at the beginning of the digging stroke;

(4) circuit means for applying the signal generated by said computer means to the power-actuating means controlling the outreach boom; and (5) means for controlling the power-actuating means for said digging bucket as a linear function of the sum of said signals proportional to said Angles A and B, thereby determining Angle C.

6. The apparatus of claim 5 plus means responsive to a trigonometric function of angles A, B and C and the distances R1, R2 and R3 for indicating the depth of the digging edge of said bucket, where R3 is the distance from the digging edge to the pivot axis of said bucket.

* * * * *